United States Patent [19]

Hopp

[11] 4,064,612

[45] Dec. 27, 1977

[54] LOCKING TYPE GASKET FOR SPARK PLUGS HAVING FULLY THREADED SHANKS AND TOOL THEREFOR

[76] Inventor: Harold P. Hopp, 35 Industrial Road, Lodi, N.J. 07644

[21] Appl. No.: 735,600

[22] Filed: Oct. 26, 1976

[51] Int. Cl.[2] ..... B25B 27/14

[52] U.S. Cl. ..... 29/278; 277/9.5

[58] Field of Search ..... 29/278, 280, 511; 313/118; 277/9, 9.5, 236; 151/38; 85/1 JP

[56] References Cited

U.S. PATENT DOCUMENTS

| | | | |
|---|---|---|---|
| 3,099,456 | 7/1963 | Hopp | 277/236 |
| 3,299,504 | 1/1967 | Hopp | 277/9 |
| 3,332,141 | 7/1967 | Hopp | 277/9 |
| 4,003,120 | 1/1977 | Hopp | 29/278 |

*Primary Examiner*—James L. Jones, Jr.
*Attorney, Agent, or Firm*—Charles E. Temko

[57] ABSTRACT

An improved spark plug gasket particularly adapted to be installed in locked relation upon a spark plug body of a type having a fully threaded shank. The gasket includes the usual sealing flanges and a plurality of inwardly extending locking members or tabs which are staked directly against the threads of the shank adjacent the base portion thereof. A wedge-like staking tool engages the locking members as it is inserted in an interstice between the sealing flanges and the locking members to radially inwardly force the locking members against the threads on the shank, and deform the locking members to at least partially conform to the threads.

2 Claims, 6 Drawing Figures

LOCKING TYPE GASKET FOR SPARK PLUGS HAVING FULLY THREADED SHANKS AND TOOL THEREFOR

BACKGROUND OF THE INVENTION

In my copending application, Ser. No. 593,985, filed July 8, 1975, there is disclosed an improved locking type spark plug gasket and tool for installing the same in which a plurality of S-folded sealing flanges terminate in an angularly disposed segmented locking flange which extends radially inwardly of the sealing flanges at an angle thereto. During installation, a hollow cylindrical tool surrounds the threaded shank in such manner that the free circular edge thereof contacts surfaces of the locking flange to deform the same to a plane parallel to that of the sealing flanges, in which condition the segmented edge of the locking flange is positioned within a circular undercut recess between a radial surface of the spark plug body and the inner end of the threaded portion of the shank. At the completion of installation, very little distortion of the inner end of the locking flange occurs, owing to the segmented configuration thereof.

Certain brands of spark plugs manufactured in the United States and elsewhere are provided with spark plug bodies, the shanks of which are threaded by a rolling operation rather than by cutting, and in which the thread extends at its inner end to the radially positioned surface of the plug body from which the shank extends, without any circular recess whatsoever. In such construction, gaskets of the type disclosed in the above mentioned application cannot be uniformly staked in position owing to the absence of the recess, and in the case of rolled threads, there is a tendency to accumulate varying degrees of excess metal at the inner end of the above thread, such that prior art gaskets designed for this type of threaded shank do not engage the shank properly. In a hand staking operation this presents less difficulty. In commercial manufacture, however, it is usual to install the gasket as a completely automated line of operation, and the inability of a gasket to properly seat gives rise to malfunctioning a machinery making the installation, and an improperly seated gasket will not properly seal when the plug is installed in an engine.

SUMMARY OF THE INVENTION

Briefly stated, the invention contemplates the provision of an improved locking type spark plug gasket particularly adapted for installation as an in-line operation upon the completely threaded shanks of spark plugs of the above described type, together with an improved installation tool particularly adapted for this purpose. The gasket is characterized in the locking structure comprising a plurality of locking tabs which, before locking on the shank of the plug, have a principal axis lying substantially parallel to the axis of the threaded shank, and are crimped by radially inward movement against the threads. The installation tool is of wedge-shaped configuration at the operative end thereof, and is adapted to fit within an interstice between the locking tabs and the sealing flanges to press against the inner surfaces of the tabs and thereby bend them against portions of the threaded shank. The radially inwardly directed force involved in this operation is sufficiently great that the tabs are distorted to at least partially conform to the cross section of the engaged thread, thereby providing an effective locking action.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENTS

Figure 1:
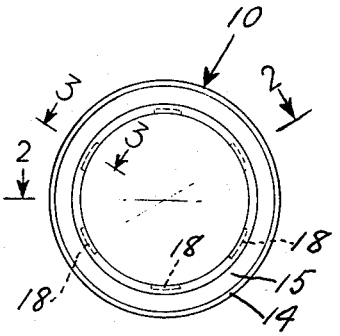
FIG. 1 is a view in elevation of an embodiment of the invention.
Figure 2:
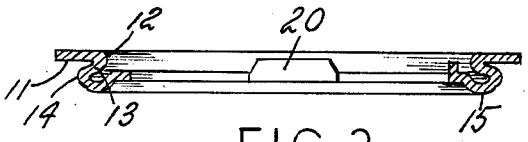
FIG. 2 is a longitudinal central sectional view thereof.
Figure 3:
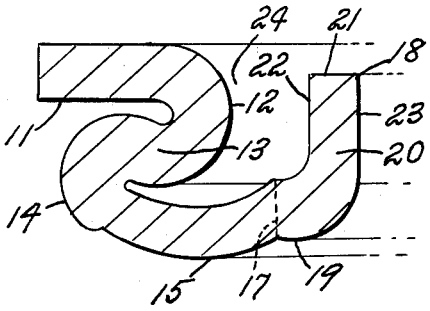
FIG. 3 is a fragmentary substantially enlarged sectional view as seen from the plane 3—3 in FIG. 1.

In accordance with the invention, the device, generally indicated by reference character 10 (FIGS. 1 to 3, inclusive) is preferably formed as a metallic stamping, in a manner well known in the art. It includes a first sealing flange 11 interconnected by a curved portion 12 to a second sealing flange 13, in turn interconnected to a curved portion 14 leading to a third sealing flange 15. The flanges are illustrated in uncompressed condition in FIG. 3, the surfaces of the same being brought into abutted relation during installation of the spark plug to which the device is attached in the cylinder head of an internal combustion engine. Formed integrally with the inner periphery 17 of the flange 15 are a plurality of locking tabs 18, each tab including a transversely extending portion 19 and a longitudinally extending portion 20 terminating in an edge 21. The longitudinally extending portion 20 is bounded by an inwardly facing surface 22 and an outwardly facing surface 23. Again, as best seen in FIG. 3, the surface 22 and the inward surface of the portion 12 form a circular interstice 24 permitting the entry of a tool element to be hereinafter described.

Figure 4:
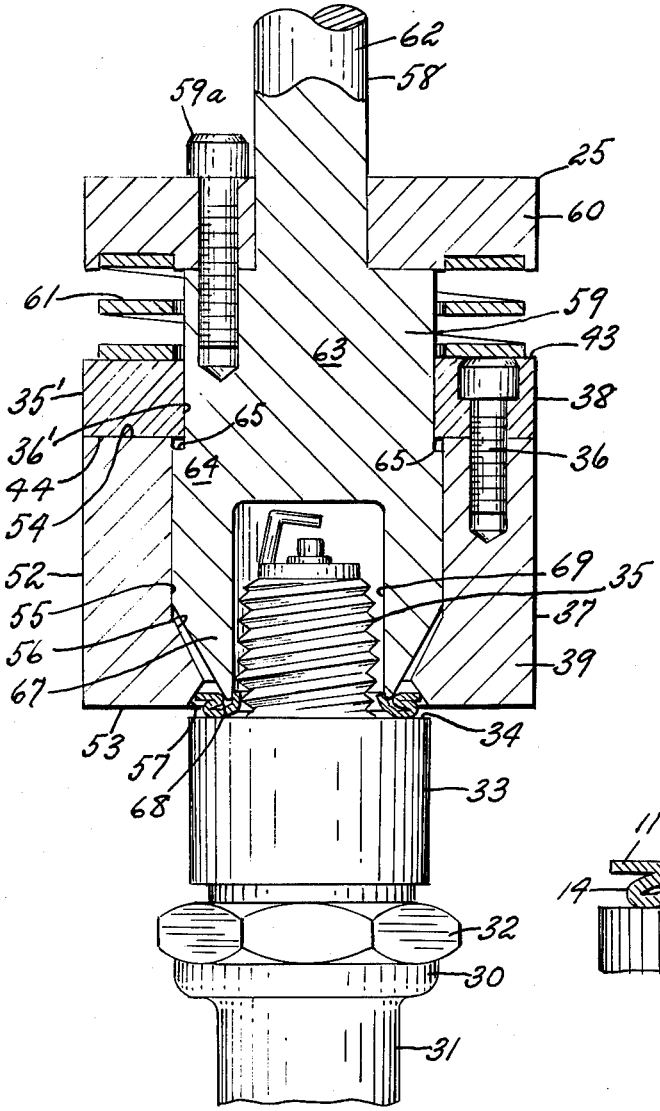
FIG. 4 is a longitudinal central section view of a spark plug body, associated gasket and an installation tool in operative position thereon.

Reference is made to FIG. 4 which illustrates a spark plug 30 of conventional type includes a core 31 and a metallic plug body 32, a lower portion 33 of which is bounded by a radially extending surface 34. A threaded shank 35 includes threads extending to said surface.

An installation tool, generally indicated by reference character 25 is of a type particularly adapted for in line, multistage assembly operation. It will be appreciated by those skilled in the art that a much simpler tool may be employed where hand installation of the gasket 10 upon the shank 35 is desired. The tool 25 includes a main body element 37 including an upper member 38 and a lower member 39 interconnected by threaded means 36.

The upper member 38 is bounded by an upper surface 43, a lower parallel surface 44, an outer cylindrical surface 35' and a centrally disposed bore 36'.

The lower member 39 is bounded by an outer surface 52, a lower surface 53, an upper surface 54 and a cylindrical bore 55 communicating with an inwardly tapered bore 56, in turn communicating with an outwardly tapered bore 57.

A centrally disposed punch element 58 includes a main body member 59 and an annular collar member 60 supported by a flat coil spring 61 overlying the element 37 and interconnected to member 59 by threaded means 59*a*. The main body member 59 includes a shaftlike portion 62 through which downward motion is transmitted. A central portion 63 has an outer diameter corresponding to that of the bore 36', and a lower portion 64 has a diameter corresponding to that of the bore 55. The intersection of the portion 63 and 64 forms a shoulder 65 enabling the element 58 to be captivated within the main body element 37. The lower portion 64 includes a tapered lower end 67 having a rounded free edge 68, and a centrally disposed bore 69, the diameter of which is slightly greater than the crown diameter of the thread on the shank 35. The clearance, however, is slightly less than the thickness of the locking tabs 18, so that after the edge 68 of the lower end 67 has passed the edge 21 of each of the locking tabs, continued radially inwardly directed pressure is exerted on the outwardly facing surface 23 of each tab to result in deforming the same to at least partially correspond to the configuration of the thread. In some cases, this will result in positioning the edges 21 in the continuous spiral recess between the crown and root diameters. In other cases, a medial portion of the tab will be engaged upon the crown of the thread, with metal comprising the tab on either side of the crown being partially forced into the spiral recess to provide an equivalent result.

When the staking operation has been accomplished, raising the tool will cause expansion of the spring 61, causing relative movement between the element 37 and the element 58, wherein the former serves as an ejector by exerting pressure on the outer edge of the sealing flange 11.

Figure 5:
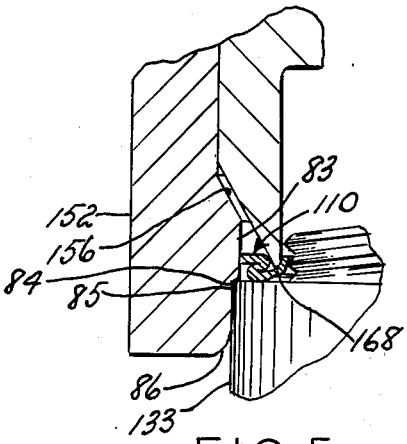
FIG. 5 is a similar fragmentary sectional view showing an alternate form of tool.
Figure 6:
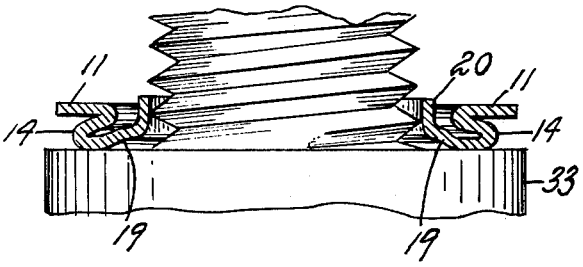
FIG. 6 is a sectional view of an integrated plug and gasket.

Turning now to the alternate form of tool illustrated in FIG. 5, to avoid needless repetition, parts corresponding to those of the principal form have been designated by similar reference characters with the additional prefix "1".

The form illustrated in FIG. 4 is particularly suited to those cases where the outer diameter of the gasket is substantially equal to the outer diameter of the plug body, so that in ejecting the assembled plug and gasket, it is most convenient to bear upon the outermost edge of the gasket.

In certain plug sizes, the diameter of the plug body is considerably greater than the diameter of the threaded shank, and the gasket, in installed condition exposes a portion of the plug body therebeneath. In the embodiment shown in FIG. 5, the main body element 137 is modified to provide a cylindrical bore 83 which clears the gasket, and provides a shoulder 84 which rests upon the plug body. A second concentric bore 85 includes a camming portion 86 which enables the bore 85 to surround the plug body and accomplish a centering function directly upon the plug body prior to the crimping of the locking tabs upon the thread of the plug.

I wish it to be understood that I do not consider the invention limited to the precise details of structure shown and set forth in this specification, for obvious modifications will occur to those skilled in the art to which the invention pertains.

I claim:

1. In a combination spark plug and captive gasket therefore, in which said spark plug includes a plug body having a threaded shank extending outwardly therefrom, said threaded shank having threads thereon extending substantially the entire lenght of said shank, said gasket including a plurality of mutually compressible sealing flanges and a locking flange extending inwardly of said sealing flanges, said threaded shank having a given pitch and defining a continuous spiral recess between adjacent convolusions of said thread, the improvement comprising: said locking flange including a plurality of locking tabs, each tab including a main body portion lying inwardly of said sealing flanges, and generally longitudinally oriented with respect to the principal axis of said threaded shank, and a transversely extending portion interconnecting said longitudinally extending main body portion to one of said sealing flanges; said tabs having an effective length along said longitudinal axis substantially equal to the combined thickness of said sealing flanges in compressed condition, and being disposed within the area encompassed by said plurality of sealing flanges, whereby said longitudinally extending portions and sealing flanges define an arcuately-shaped interstice for the insertion of a staking tool therein; said locking tabs, in installed condition overlying portions of said thread, and being deformed to a degree wherein the radially inward surfaces thereof at least partially conform to the configuration of said thread.

2. A combination spark plug and captive gasket therefore in accordance with claim 1, in combination with a tool for installing said gasket upon said spark plug, said tool including: a first member having a bore therein of dimension corresponding to the diameter of said gasket, and in operative position serving to align said plug body and gasket; a second generally concentrically disposed member having a free edge adapted to enter said interstice in said gasket to deform said locking tabs in a radially inward direction against said thread; and resilient means interconnecting said first and second members, said resilient means being compressed upon deformation of said gasket, and causing said first member to serve as a gasket ejection means after completion of a deforming operation.

* * * * *